United States Patent [19]

Keith

[11] Patent Number: 4,460,407

[45] Date of Patent: Jul. 17, 1984

[54] METHOD OF PREPARING MAGNESIUM ALLOY PARTICLES

[75] Inventor: Earl K. Keith, Clute, Tex.

[73] Assignee: The Dow Chemical Company, Midland, Mich.

[21] Appl. No.: 450,947

[22] Filed: Dec. 20, 1982

[51] Int. Cl.[3] ..... B22F 9/00

[52] U.S. Cl. ..... 75/0.5 C; 75/251; 420/590; 264/9

[58] Field of Search ..... 75/0.5 C, 3, 251, 67 R; 420/590, 407, 408; 264/9; 148/420

[56] References Cited

U.S. PATENT DOCUMENTS

| | | | |
|---|---|---|---|
| 447,511 | 3/1891 | Goetz | 264/9 |
| 1,327,743 | 1/1920 | Tebbetts | 264/9 |
| 2,059,230 | 11/1936 | Hall et al. | 75/0.5 C |
| 2,061,696 | 11/1936 | DeBats | 75/0.5 C |
| 2,510,574 | 6/1950 | Greenhalgh | 264/9 |
| 2,659,133 | 11/1953 | Leontis et al. | 420/407 |
| 2,892,215 | 6/1959 | Naeser et al. | 264/9 |
| 3,840,364 | 10/1974 | Flemings et al. | 420/590 |
| 4,065,299 | 12/1977 | Roberts et al. | 75/3 |

*Primary Examiner*—L. Dewayne Rutledge
*Assistant Examiner*—Robert L. McDowell
*Attorney, Agent, or Firm*—W. J. Lee

[57] ABSTRACT

Molten magnesium alloy is stirred under a substantially inert atmosphere as it is cooled to freezing, thereby forming discrete solid particles of the alloy. The process may be carried out batch-wise or continuously.

20 Claims, No Drawings

METHOD OF PREPARING MAGNESIUM ALLOY PARTICLES

BACKGROUND OF THE INVENTION

Magnesium metal and magnesium alloys in the form of particles ranging from powder size to pellet or granule size are known to be useful, such as for inoculation of molten ferrous melts, for alloying with other metals, for pyrotechnic applications, and as a source of magnesium for mixing with, or reacting with, other ingredients.

The present invention pertains to the preparation of useful magnesium alloy particles directly from molten metal in contradistinction to methods wherein particles are made by grinding or chopping large solid pieces of metal into small pieces and in contradistinction to methods wherein metal vapors are condensed as droplets and cooled below freezing.

There is a metal granulation technique known as "graining" whereby molten metal is agitated as it is cooled to its freezing point, whereby disperse nucleating sites are provided for growth of metal crystals as the metal cools to below its melting point. These nucleating sites may be provided by addition of various insoluble substances, such as metal oxides, fluxes, and the like, or may be formed by the oxidation of part of the metal being cooled in the presence of oxygen, air, or moisture. These nucleating sites, whether provided by intentionally-added insoluble ingredients or by in-situ formation of insoluble oxides, provide a liquidus range for the cooling of the metal to permit the "graining" of the metal to solid particles (by agitation) rather than having the metal freeze into a continuous mass.

It has now been found that molten magnesium can be formed into granules or pellets by agitating the metal as it is cooled to below its melting point if soluble alloying metals are added, while protecting the magnesium from the inclusion of insoluble nucleating agents, including those formed by exposing the molten magnesium to oxygen or other substances which react with the magnesium to form oxides or other insoluble materials.

SUMMARY OF THE INVENTION

Molten magnesium alloy is stirred under a substantially inert atmosphere as it is cooled to freezing, thereby forming discrete solid particles of the alloy. Either batch or continuous operation may be used.

DESCRIPTION OF THE INVENTION

Molten magnesium containing minor quantities of alloying materials is stirred as it cools down through its freezing (thixotropic) range. When frozen, the metal is in the form of discrete particles.

The freezing (thixotropic) range for the alloys is broader than for magnesium alone, thus substantial control of the particle size and freezing uniformity is made possible by the use of alloying ingredients. This freezing range is referred to herein as the "slurry region" or "slurry range". Depending on the alloying material and its concentration, the slurry region should extend over a range of at least about 10° C., preferably at least about 20° C., and can be about 100° C. or more. It is the stirring of the melt as it cools down through the slurry region that creates the discrete particles of metal. It appears that in the slurry region crystal growth can occur and it is apparently around these crystals that molten metal freezes and the particles accrue in size.

Prior to and during the final freezing of the molten alloy around the crystals, agitation is possible which prevents the molten phase from freezing as a continuous phase into a solid mass as will happen when freezing non-alloyed magnesium which has little or no "slurry range".

As alloying ingredients one may use a metal which has a melting point above or below that of magnesium, so long as the metal is at least soluble to an extent great enough to form an alloy with magnesium. Of particular interest as alloying ingredients are at least one of aluminum, zirconium, zinc, copper, cerium, arsenic, barium, cadmium, calcium, cobalt, lead, manganese, nickel, silver, and tin. Some of the above named metals are only slightly soluble in molten magnesium when used singly, but may be more soluble when used with other alloying ingredients. Some metals which may be only marginally soluble or substantially insoluble when used singly are antimony, beryllium, bismuth, and silicon, but may be more soluble when used with other alloying ingredients. It is within the skill of practitioners, after learning of the present inventive concept, to determine the suitability of a particular metal, or mixture of metals, or alloys or metals for use in the present invention. The present inventive concept relies on having alloyed materials in the magnesium, not in having insoluble particles in the magnesium to act as nucleating sites.

The temperature at which the magnesium and the alloying agent is molten will depend on the alloying agent. The temperature range of the slurry region will depend on the alloying agent and its concentration in the magnesium. For instance, an alloy of magnesium containing, say, about 2% aluminum would have a slurry range of about 50° C. and an alloy of about 15% aluminum would have a slurry range of about 116° C. Crystal growth (discrete phase) occurs over the slurry range, as the melt (liquid phase) cools, giving rise to formation of discrete frozen particles so long as there is sufficient agitation to prevent any of the liquid phase from freezing as a continuous phase.

As the inert environment employed to prevent oxidation of the molten metal, one may employ any conveniently available material to shield the melt from oxygen, air, and moisture. Argon is one of the noble (inert) gases which is widely available; sulfur hexafluoride ($SF_6$) is effective as a shield to protect molten magnesium from air and moisture. Mixtures of inert gases may be used.

The agitation means needs to be strong enough to stir the melt as it cools down through the slurry range where the mechanical agitation causes the metal or alloy to form first as discrete semi-molten particles, then on further cooling to frozen particles. An orbital agitator is generally satisfactory, though any agitator which accomplishes the purpose may be used. The process may be carried out batch-wise or continuously.

The magnesium alloy granules or pellets prepared in accordance with the present invention are usually found, under magnification, to be agglomerates of tiny particles and have high surface area. Generally, the average particle size of each agglomerate is dependent on the severity of the agitation; the more severe the agitation, the smaller the agglomerates. Using just enough agitation to prevent solidification into a continuous mass, it is found that nearly all the pellets will fall through a 4 mesh screen and a sizeable amount will fall through a 10 mesh screen.

The following embodiments are given to illustrate the practice of the invention, but the invention is not limited to the particular embodiments illustrated.

For the following examples there is used a gas fired furnace that is about 48 inches in diameter and about 30 inches high and which contains a crucible of 1-inch thick carbon steel that has a diameter of about 20 inches and a depth of about 22 inches. The furnace is equipped with two 1-inch venturi gas burners operating on natural gas (methane) at 7 psig. Two pilot burners provide the ignition source and are controlled by a flame-out shut-down unit. The furnace temperature is controlled by an automatic controller and monitored at 4 different points on a multipoint temperature controller. The crucible is equipped with a cover and a sliding door. The inert gas is supplied to the crucible through a ¼-inch tube which communicates with the interior of the crucible. While the charge of alloy is molten, an agitator (driven by a ½-inch drill motor) is inserted through the top of the crucible and agitation is continued and the inert gas blanket is maintained when the gas burners are shut off to permit the melt to cool to freezing. Cooling is speeded up by blowing cool air through the furnace around the outside of the crucible.

EXAMPLE 1

Into a pot (described above) is placed 50 pounds of magnesium and 5 pounds of aluminum. The pot is padded with $SF_6$ gas. The mixture is melted to about 670° C. to 700° C. and stirred to form the alloy. With continued stirring using a stirrer driven by a ½-inch drill motor as the stirring means, the metal is cooled (under the protective $SF_6$ pad) at a rate of about 20° C. per minute until the temperature drops below about 425° C. The alloy particles thus formed are poured out of the pot as free flowing pellets.

EXAMPLE 2

(Comparative Example; Not of Invention)

In attempting to use substantially pure, primary magnesium (without any alloying ingredients or graining ingredients added) in the same procedure as Example 1 above, it is found that the magnesium metal begins to freeze on the walls of the crucible as the crucible is cooled and the "frozen wall" grows inwardly and soon freezes the agitator in place, thereby substantially preventing the formation of any free-flowing magnesium granules.

EXAMPLE 3

A molten alloy mixture of magnesium (90 parts), aluminum (9 parts), and zinc (1 part) is agitated, under a protective blanket of argon, while being cooled, until the alloy is frozen into pellets. The pellets are free-flowing and are poured from the crucible. The pellets, being substantially free of oxides or other insolubles, are useful as feed stock for die-castings where insoluble occlusions are desirably avoided.

EXAMPLE 4

Under an argon blanket primary magnesium (49.7 parts) and cerium (6.7 parts) are melted to form a magnesium alloy containing about 11.8 percent cerium. The molten alloy is stirred, under the argon blanket, and is cooled with stirring until it is frozen into pellets. The pellets are useful as an additament to molten iron as desulfurizing and nodularizing agent.

EXAMPLE 5

For continuous graining of magnesium alloys there is provided a tube about 6 feet long and 10 inches inside diameter with mixer blades affixed to an axle which runs the length of the tube and which is driven by a motor which is outside the tube. By using induction heaters spaced along the outside of the tube and by controlling the output of the heaters, the temperature of the magnesium alloy in the tube is gradiently controlled. Molten magnesium alloy is fed to the tube (while being protected with an inert gas blanket) at one end (about 650° C.) and the alloy travels through the tube as the mixer blades are operating until it leaves the last portion of the tube (about 300° C.) as pellets or granules.

I claim:

1. A method for preparing particles of magnesium alloy, said process comprising, stirring a melt of said alloy under an inert atmosphere while cooling sufficiently, and at a cooling rate, to form crystalline occlusions dispersed in the melt, thereby converting said melt to a slurry having a slurry temperature range of at least about 10° C., said slurry having a discrete solid phase and a liquid phase, continuing said stirring, inert atmosphere, and cooling to cause the liquid phase to freeze in disperse manner onto the solid phase as the temperature drops below said slurry temperature range, and removing from the pot the so-formed solid particles of metal as free-flowing pellets.

2. The method of claim 1 wherein the magnesium alloy comprises a predominant amount of magnesium alloyed with a minor amount of at least one metal selected from the group consisting of aluminum, zirconium, zinc, copper, cerium, arsenic, barium, cadmium, calcium, cobalt, lead, manganese, nickel, silver, and tin.

3. The method of claim 1 wherein the magnesium alloy comprises a predominant amount of magnesium alloyed with a minor amount of at least one metal selected from the group consiting of aluminum, zinc, and cerium.

4. The method of claim 1 wherein the magnesium alloy comprises a predominant amount of magnesium alloyed with a minor amount of aluminum and zinc.

5. The method of claim 1 wherein the magnesium alloy comprises a predominant amount of magnesium alloyed with a minor amount of aluminum.

6. The method of claim 1 wherein the magnesium alloy comprises a predominant amount of magnesium alloyed with a minor amount of zinc.

7. The method of claim 1 wherein the magnesium alloy comprises a predominant amount of magnesium alloyed with a minor amount of cerium.

8. The method of claim 1 wherein the inert atmosphere comprises argon.

9. The method of claim 1 wherein the inert atmosphere comprises sulfur hexafluoride.

10. The method of claim 1 wherein the slurry temperature range is at least about 20° C.

11. The method of claim 1 when performed in a continuous manner in which molten magnesium alloy, excluding oxide-forming reactants, is fed continuously to a stirred vessel, the alloy flowing through the vessel being cooled to freezing before it exits the vessel at a point distal to that of the feed, and collecting particles of magnesium alloy which flow from the exit.

12. A method for graining magnesium into solid discrete particles, said method comprising alloying the magnesium with a minor amount of at least one alloying metal selected from the group consisting of aluminum, zirconium, zinc, copper, cerium, arsenic, barium, cadmium, calcium, cobalt, lead, manganese, nickel, silver, and tin, thereby creating an alloy having a slurry temperature range of at least about 10° C., stirring the alloy at molten temperature under an inert atmosphere to prevent formation of oxides or other insoluble ingredients, and cooling the alloy, while stirring, until the alloy has cooled to freezing at a temperature below the slurry temperature range, thereby forming solid discrete alloy particles.

13. The method of claim 12 wherein the alloying metal is at least one selected from the group consisting of aluminum, zinc, and cerium.

14. The method of claim 12 wherein the alloying metal is aluminum or zinc.

15. The method of claim 12 wherein the alloying metal is aluminum.

16. The method of claim 12 wherein the alloying metal is zinc.

17. The method of claim 12 wherein the alloying metal is cerium.

18. The method of claim 12 wherein the slurry temperature range is at least about 20° C.

19. The method of claim 12 wherein the inert atmosphere comprises argon.

20. The method of claim 12 wherein the inert atmosphere comprises sulfur hexafluoride.

* * * * *